US011547179B2

(12) United States Patent
Urbin

(10) Patent No.: US 11,547,179 B2
(45) Date of Patent: Jan. 10, 2023

(54) TACTILE FEEDBACK SHOE SOLE

(71) Applicant: Adam Michaels Urbin, Westborough, MA (US)

(72) Inventor: Adam Michaels Urbin, Westborough, MA (US)

(73) Assignee: Adam Urbain, Westborough, MA (US)

( * ) Notice: Subject to any disclaimer, the term of this patent is extended or adjusted under 35 U.S.C. 154(b) by 205 days.

(21) Appl. No.: 17/020,973

(22) Filed: Sep. 15, 2020

(65) Prior Publication Data

US 2020/0405008 A1 Dec. 31, 2020

Related U.S. Application Data

(63) Continuation-in-part of application No. 16/161,058, filed on Oct. 16, 2018, now Pat. No. 10,813,408.

(51) Int. Cl.
*A43B 13/20* (2006.01)
*A43B 7/1455* (2022.01)

(52) U.S. Cl.
CPC ..... *A43B 13/20* (2013.01); *A43B 7/146* (2013.01)

(58) Field of Classification Search
CPC ..... A43B 13/20; A43B 7/146
USPC ..... 36/29, 141
See application file for complete search history.

(56) References Cited

U.S. PATENT DOCUMENTS 1,069,001 A * 7/1913 Guy ..... A43B 7/06 36/29
2,488,382 A * 11/1949 Davis ..... A43B 13/20 36/153
3,765,422 A * 10/1973 Smith ..... A43B 17/03 36/153
4,446,634 A * 5/1984 Johnson ..... A43B 13/203 36/43
4,458,430 A * 7/1984 Peterson ..... A43B 13/203 36/35 B
4,999,931 A * 3/1991 Vermeulen ..... A43B 13/185 36/153
5,313,717 A * 5/1994 Allen ..... A43B 13/20 36/35 B
5,365,678 A * 11/1994 Shibata ..... A43B 13/20 36/43
5,956,869 A * 9/1999 Kim ..... A43B 13/20 36/28
6,367,174 B1 * 4/2002 Shibata ..... A43B 7/146 36/141
9,015,961 B2 * 4/2015 Graziani ..... A43B 7/081 36/35 B (Continued)

*Primary Examiner* — Marie D Bays

(57) ABSTRACT

A tactile feedback shoe sole for footwear comprising a main body that defines a toe portion, a middle portion and a heel portion. A first chamber filled with a fluid is disposed in one or more areas of the main body. A second chamber comprising a second chamber upper wall, a second chamber lower wall and projections is disposed in the arch region of the middle portion. Channels disposed between the first and the second chambers help in establishing fluidic communication between the first and second chambers. If the second chamber is compressed before the first chamber getting compressed, which is likely to happen when the feet of the user of the sole overpronate, the second chamber upper wall comes in contact with the second chamber lower wall and the projections are felt by the user in the arch region since the second chamber is not filled with the fluid.

10 Claims, 11 Drawing Sheets

(56) References Cited

U.S. PATENT DOCUMENTS

| | | | | |
|---|---|---|---|---|
| 10,813,408 | B2 * | 10/2020 | Urbin | A43B 13/186 |
| 2003/0101619 | A1 * | 6/2003 | Litchfield | A43B 13/203 36/29 |
| 2005/0000116 | A1 * | 1/2005 | Snow | A43B 3/128 36/28 |
| 2005/0229432 | A1 * | 10/2005 | Lo | A43B 13/206 36/35 B |
| 2008/0040948 | A1 * | 2/2008 | Park | A43B 7/142 36/43 |
| 2008/0301975 | A1 * | 12/2008 | Fusco | A43B 7/14 36/43 |
| 2009/0188129 | A1 * | 7/2009 | Fusco | A43B 17/02 36/44 |
| 2011/0072684 | A1 * | 3/2011 | Stubblefield | A43B 13/122 36/28 |
| 2014/0230272 | A1 * | 8/2014 | Feshbach | A43B 13/20 36/28 |
| 2015/0313310 | A1 * | 11/2015 | Okamoto | A43B 7/146 36/31 |
| 2019/0090583 | A1 * | 3/2019 | Sato | A43B 7/149 |
| 2020/0085139 | A1 * | 3/2020 | Izquieta Anaut | A43B 13/181 |
| 2021/0282498 | A1 * | 9/2021 | Yahata | A43B 7/18 |

* cited by examiner

TACTILE FEEDBACK SHOE SOLE

CROSS REFERENCE TO RELATED APPLICATIONS

This application is a continuation-in-part of U.S. patent application Ser. No. 16/161,058 filed on Oct. 16, 2018, which is incorporated in its entirety herein by reference.

FIELD OF THE INVENTION

The present invention relates to footwear. More particularly, the present invention relates to providing feedback to a user of footwear toward attaining a desired gait during walking or running.

BACKGROUND OF THE INVENTION

Some runners/walkers strike the ground with their heel first, termed "rearfoot running" or "heel strike", and is arguably the most common foot strike pattern amongst runners. Then there is running/walking technique in which the ball of the foot touches the ground first, termed "forefoot running" or "forefoot strike" or "ball strike". Proponents of forefoot running believe that it is more natural and biomechanically faster than rearfoot running. Perhaps, when we run barefoot, almost everyone of us run on toes or forefoot. Forefoot strike running may also alleviate many of the harmful effects associated with heel strike running and, thus, can help reduce injury risks. So, a common trend in running nowadays is to transition from traditional rearfoot running form to forefoot running. But, this can be a difficult transition for people to make as they are changing a learned habit.

Prior art provides footwear articles which are suitable for forefoot strike or which support forefoot running. But, such products do not directly discourage a runner from being rearfoot runner.

Both in rearfoot running/walking and forefoot running/walking, at one point of time, the middle of the foot with the raised arch descends to the ground. This flattening of the feet with the arch slightly lowering in the middle of the foot is referred to as internal rotation or pronation. A normal degree of pronation is not a problem, because it reduces the impact by spreading the impact on the foot evenly throughout the sole of the foot. However, if the feet overly flatten i.e. excessively pronate or overpronate with the ankles severely bending inward, then it is a problem.

Shoes or insoles exit in prior art which are designed to prevent overpronation. However, such products do not make the users aware when they overpronate.

Thus, there exists a need for a footwear article which helps a user in switching from one running technique to another and in correcting the gait.

OBJECTS OF THE INVENTION

An object of the present invention to provide a footwear article that gives feedback to a runner to change to forefoot running from rearfoot running or vice versa, as desired.

Another object of the present invention is to provide a footwear article that provides tactile feedback to a user without using any external power source.

Yet another object of the present invention is to provide an inexpensive feedback system toward attaining forefoot running technique.

Still another object of the present invention is to provide a footwear article that helps a user in correcting pronation and supination.

These as well as other objects of the present invention are apparent upon inspection of this specification, including the drawings attached hereto.

SUMMARY OF THE INVENTION

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The present invention is directed to a footwear article which can help a person to attain a desired walking or running technique. The footwear article of the present invention provides a tactile feedback to the user when the user fails to put the foot in the way that is required to attain a desired walking or running technique. The feedback mechanism does not require any external power source. The shoe sole of the present invention comprises a first chamber filled with a fluid disposed in the toe section of the sole and a second chamber having one or more projections disposed in the heel section of the sole. When the second chamber is inflated, the projections move away from the upper wall/surface of the second chamber. A channel is provided to bring the two chambers in fluid communication with each other when required. Under normal condition i.e. when no force is exerted on the first chamber or on the second chamber the first chamber remains filled with the fluid. If the first chamber is pressurized first before exerting pressure on the second chamber, which is likely to happen when the user of the sole walks or runs as per forefoot running or ball strike technique, the fluid from the first chamber flows to the second chamber and the fluid in the second chamber does not allow contact of the heel of the user to come in contact of the projections present in the inflated second chamber. But, if the heel of the user lands on the second chamber first before the first chamber gets compressed, which happens during heel strike or rearfoot running, the user feels discomfort on the heel because of the projections which come directly under the heel in absence of any shock absorbing fluid in the second chamber.

In another embodiment of the present invention, sole/insole of the present invention is designed to give tactile feedback to the users of the shoe sole/insole if they overpronate. In this embodiment, the tactile feedback shoe sole for footwear comprises a first chamber which is placed on one or more areas of the toe portion, middle portion and heel portion of the main body. The first chamber remains filled with a fluid in an uncompressed state. A second chamber is disposed in one or more areas of an arch region in the middle portion of the main body of the sole/insole. The second chamber comprises a second chamber upper wall, a second chamber lower wall and one or more projections disposed on said second chamber lower wall. The second chamber is configured to allow the second chamber upper wall to come in contact with the one or more projections of the lower wall when the second chamber is in a compressed state under an external pressure and the first chamber is in an partially or fully uncompressed state. Channels disposed at the arch portion between the first chamber and the second chamber are configured to establish a fluidic communication between the first chamber and the second chamber when required.

The fluid flows from the first chamber to the second chamber through the channels and fills the second chamber to prevent the second chamber upper wall from coming in contact with the projections even under an external pressure when the first chamber was in a compressed state before the second chamber is compressed and the fluid flows back to the first chamber when the first chamber is in uncompressed state and the second chamber is compressed.

BRIEF DESCRIPTION OF THE DRAWINGS

In order to describe the manner in which features and other aspects of the present disclosure can be obtained, a more particular description of certain subject matter will be rendered by reference to specific embodiments which are illustrated in the appended drawings. Understanding that these drawings depict only typical embodiments and are not therefore to be considered to be limiting in scope, nor drawn to scale for all embodiments, various embodiments will be described and explained with additional specificity and detail through the use of the accompanying drawings in which.

DETAILED DESCRIPTION OF THE INVENTION

The following description is presented to enable any person skilled in the art to make and use the invention, and is provided in the context of particular applications of the invention and their requirements. Various modifications to the disclosed embodiments will be readily apparent to those skilled in the art and the general principles defined herein may be applied to other embodiments and applications without departing from the scope of the present invention. Thus, the present invention is not intended to be limited to the embodiments shown, but is to be accorded the widest scope consistent with the principles and features disclosed herein.

In the following detailed description, numerous specific details are set forth in order to provide a thorough understanding of the invention. However, it will be understood by those skilled in the art that the present invention may be practiced without these specific details. In other instances, well-known methods, procedures and components have not been described in detail so as not to obscure the present invention.

Figure 2A:
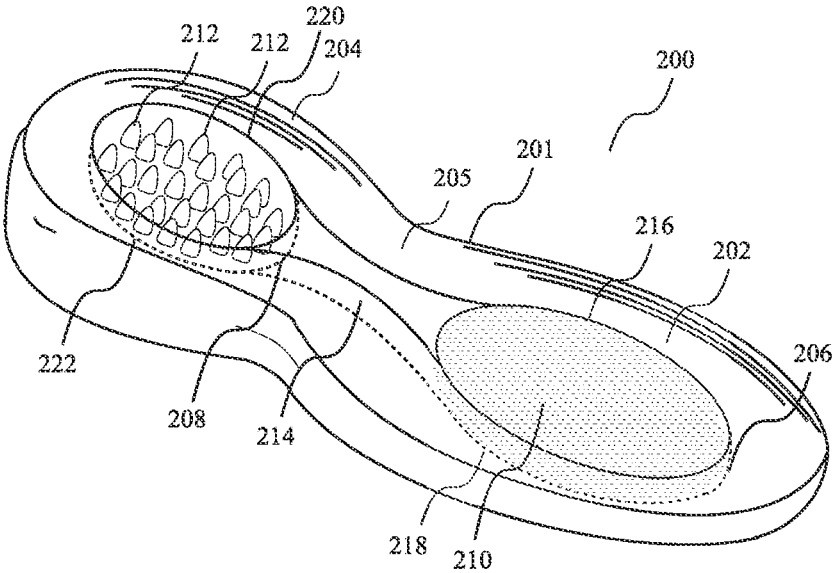
FIG. 2A illustrates perspective view of a tactile feedback shoe sole in accordance with an embodiment of the present invention.
Figure 2B:
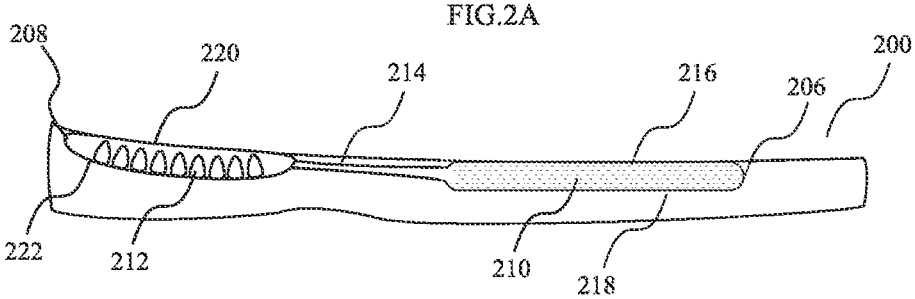
FIG. 2B is a side view of a tactile feedback shoe sole in accordance with an embodiment of the present invention.

FIGS. 2A and 2B illustrate a tactile feedback shoe sole 200 having a main body 201. The main body 201 comprises a front or toe portion 202, a rear or heel portion 204 and a middle or arch portion 205. The front portion 202 comprises a first bladder or first chamber or first chamber 206 having a first chamber upper wall 216 and a first chamber lower wall 218 spaced from said first chamber upper wall 216 and bonded together to cooperatively define a sealed toe space therebetween. The rear or heel portion 204 comprises a second bladder or second chamber or second chamber 208 having a second chamber upper wall 220 and a second chamber lower wall 222 spaced from said second upper wall 220 and bonded together to cooperatively define a sealed heel space therebetween. The upper walls 216, 220 and lower walls 218, 222 are made of flexible material which make the first chamber 206 and second chamber 208 squeezable and/or expandable under pressure and they retain their shape upon withdrawal of pressure on them.

In one embodiment, the first chamber 206 is filled with a fluid 210 which can be a viscous liquid or a gel or any other suitable fluid. In a preferred embodiment, a channel or conduit 214 is disposed at the arch portion 205 of the main body 201 between the first chamber 206 and second chamber 208 which, when required, enables in establishing a fluidic communication between the two chambers. In a preferred embodiment, the channel 214 comprises a restrictive gate which allows controlled dynamic flow of the fluid between the chambers.

Figure 2C:
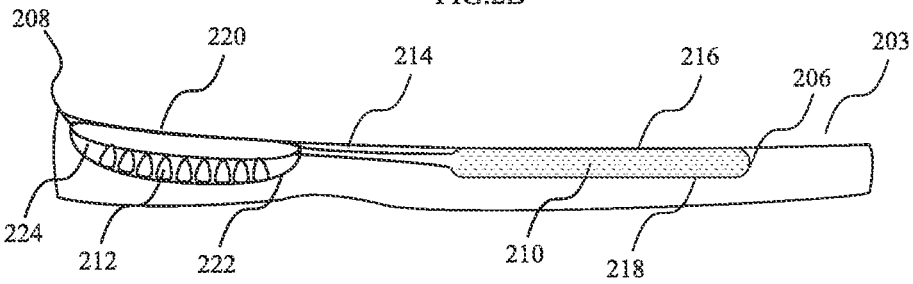
FIG. 2C illustrates a side view of another embodiment of the tactile feedback shoe sole of the present invention.

The second chamber 208 includes one or more projections 212 extending from the second chamber lower wall 222 and terminating below the second chamber upper wall 220. In a preferred embodiment, each of the projections 212 may have a predetermined dimension (e.g. a spike like shape and thickness) and the projections 212 are disposed on the second chamber lower wall 222 at positions which may correspond to the locations of the sensitive points of the heel of a person. In another embodiment 203 of the tactile feedback shoe sole, as shown in FIG. 2C, the second chamber 208 further comprises an intermediate wall 224 that separates the second chamber upper wall 220 and the second chamber lower wall 222 and the one or more projections 212 disposed on the second chamber lower wall 222 lie below the intermediate surface 224.

The tactile feedback shoe sole is configured in such a way that, when pressure is applied on the first chamber 206, it gets compressed and the fluid 210 present inside the first chamber 206 flows out of the first chamber 206 and travels through the channel 214 under pressure to enter the second chamber 208. In a preferred embodiment, the normal i.e. the unexpanded volume of the second chamber 208 is configured to be smaller than the volume of the first chamber 206. The chambers are preferably made of elastic material so that these chambers have the ability to resist a distorting influence and to return to their original size and shape when that influence or force is removed. As the second chamber 208 gets filled with the fluid 210, the space between the second chamber upper wall 220 and the second chamber lower wall 222 of the second chamber 208 increases. This results in increase in space between the second chamber upper wall 220 and the one or more projections 212 which are disposed on the second chamber lower wall 222 and the fluid 210 filling the space between the second chamber upper wall 220 and the projections 212 does not allow the second chamber upper wall 220 to touch the projections 212 even when pressure is applied on the second chamber upper wall 220 from outside.

Figure 1A:
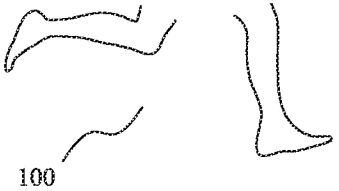
FIG. 1A illustrates side view of a runner's foot in a conventional rearfoot running and FIG. 1B to FIG. 1E illustrate different positions of the foot during the rearfoot strike run.
Figure 1B:
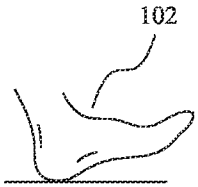
Figure 1C:
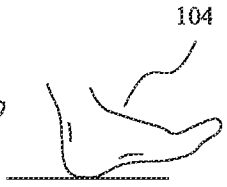
Figure 1D:
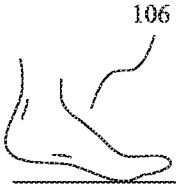
Figure 1E:
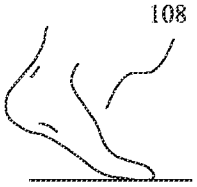
Figure 1F:
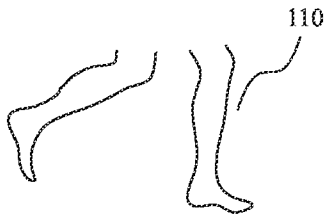
FIG. 1F illustrates side view of a runner's foot in a forefoot running technique and FIG. 1G to FIG. 1J illustrate different positions of the foot during the forefoot strike run.
Figure 1G:
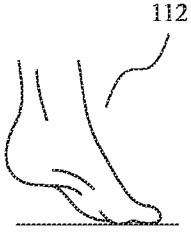
Figure 1H:
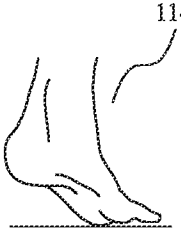
Figure 1I:
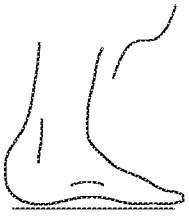
Figure 1J:
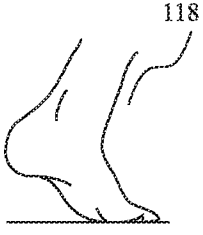
Figure 3A:
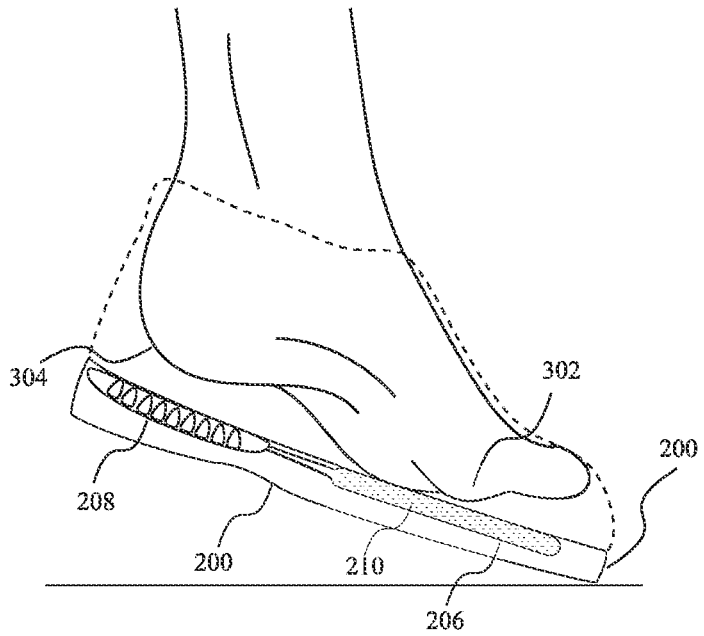
FIG. 3A illustrates a side view of a runner's foot along with the tactile feedback shoe sole before strike on the ground in a forefoot running in accordance with an embodiment of the present invention.
Figure 3B:
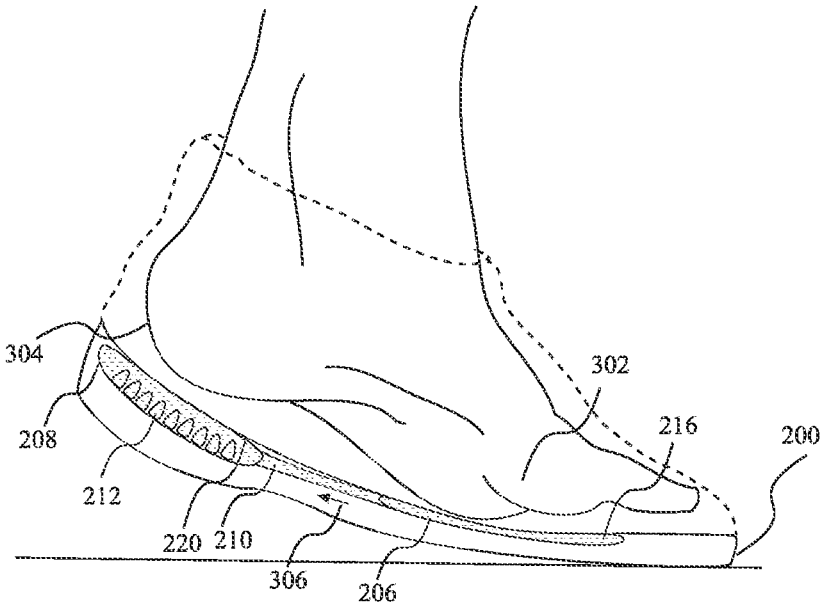
FIG. 3B illustrates side view of a runner's foot with the tactile feedback shoe sole during the forefoot strike on the ground in a forefoot running in accordance with a second embodiment of the present invention.

FIGS. 1F to 1J illustrate various positions of the foot during ball strike running. With reference to FIGS. 1F to 1H, when the foot 110 strikes the ground in forefoot running, the ball of the foot strikes the ground at foot position 112 and then transitions to position 114. FIG. 3A shows tactile feedback shoe sole 200 corresponding to foot position 112 of forefoot running. At this position, the ball 302 of the foot starts to exert pressure on first chamber 206 which remains filled with fluid 210. As the foot lands further on the ground the first chamber 206 gets compressed under the pressure exerted by the ball 302 of the foot and, as shown in FIG. 3B, the fluid 210 starts flowing out in the direction 306 through the channel 214 to fill up second chamber 208. The compression of the first chamber 206 helps in absorbing the impact with which the ball of the foot strikes the ground.

Figure 4A:
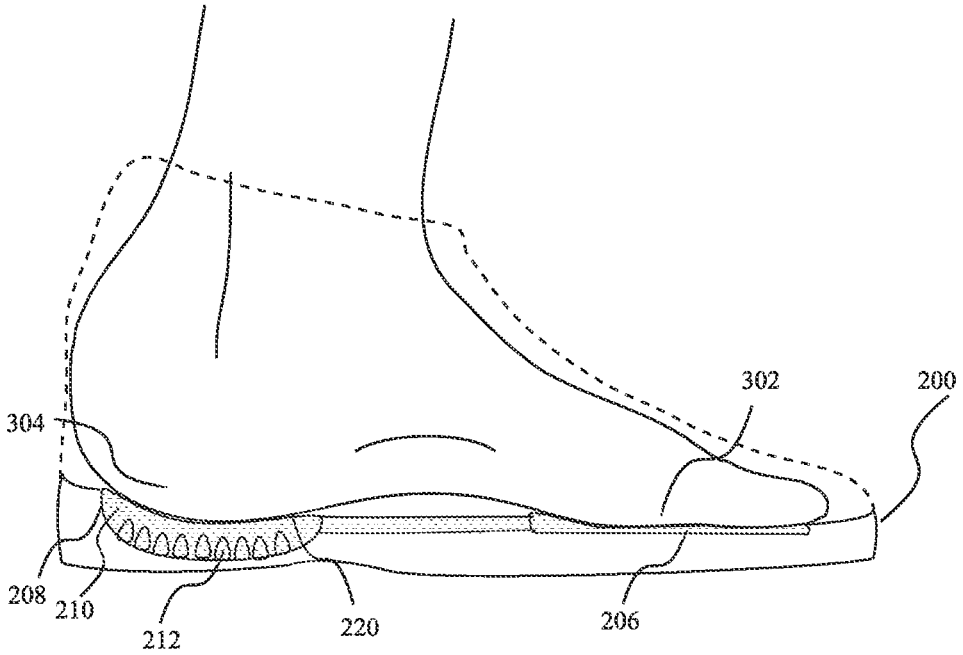
FIG. 4A illustrates side view of a runner's foot with the tactile feedback shoe sole with heel of the runner's foot resting on the heel portion of the tactile feedback shoe sole during forefoot running in accordance with an embodiment of the present invention.
Figure 4B:
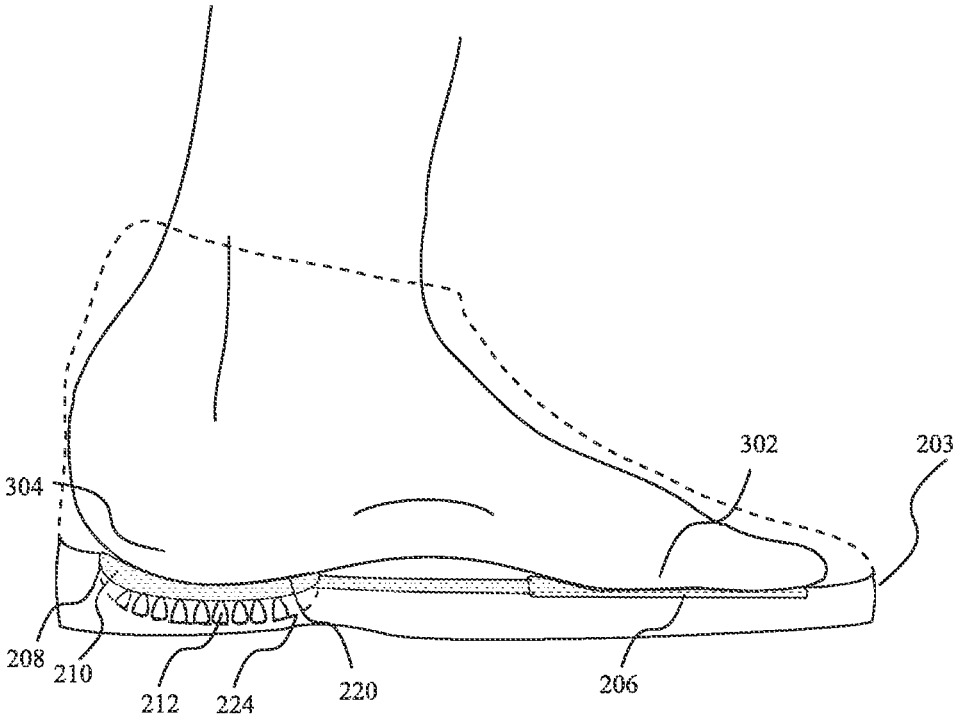
FIG. 4B illustrates side view of a runner's foot with the tactile feedback shoe sole with heel of the runner's foot resting on the heel portion of the tactile feedback shoe sole during forefoot running in accordance with a second embodiment of the present invention.

Position of the foot in FIG. 4A corresponds to the position 106 shown in FIG. 1D. At this position the whole foot i.e. the heel 304 along with the toe 302 rest on the tactile feedback shoe sole 200. Since the second chamber 208 is already filled up with fluid 210 due to compression of the first chamber 206, which has happened before the heel 304 strikes the second chamber 208, the expanded volume of the second chamber 208 attenuates and cushions impact of the heel 304 and presence of projections 212 doesn't cause any discomfort to the user and the user doesn't even feel the presence of the projections in the sole. FIG. 4B illustrates the same phenomenon occurring with the embodiment of the tactile feedback shoe sole 203. In this embodiment also the second chamber 208, inflated with fluid 210, doesn't allow the projections 212 to come in contact with the heel 304 thereby avoiding causing discomfort to the user which otherwise would have come in contact with the heel 304 had the second chamber 210 been not inflated.

Figure 5A:
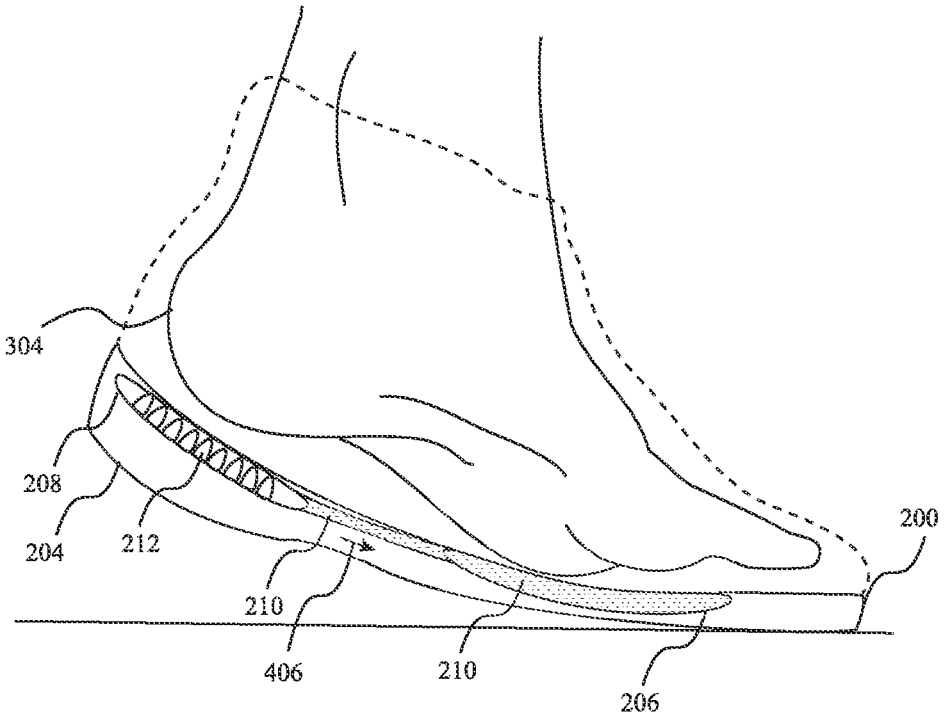
FIG. 5A illustrates side view of a runner's foot with the tactile feedback shoe sole when the heel of the runner's foot lifts from the ground during forefoot running in accordance with an embodiment of the present invention.

As with any other footwear article, the tactile feedback shoe sole 200 or 203, when worn by an individual, during running for example, repetitively contacts the ground surface and, following each contact, disengages from the playing surface. During a forefoot running, as described above with reference to FIGS. 3A, 3B, 4A & 4B, the first chamber 206 is compressed first and the second chamber 208 gets expanded due to the fluid 210 pushed from the first chamber 206. When the heel portion 204 disengages from the ground, as shown in FIG. 5A, corresponding to foot positions 106 and 108 of FIGS. 1D and 1E of forefoot running, the second chamber 208 tends to return to its initial unexpanded state. As soon as the foot completely lifts off the ground, a pressure differential develops between the second chamber 208 which tends to regain its unexpanded size and shape and the first chamber 206 which is at an uncompressed state. As a result, the fluid 210 flows back in the direction 406 from the second chamber 208 to the first chamber 206 through the channel 214. The chamber 206 and 208 are so configured that, to equalize the pressure differential, the second chamber 208 gets emptied of the fluid 210 which flows back to the first chamber 206. This way, the tactile feedback shoe sole regains its designed configuration/state of normally filled first chamber 206 and empty second chamber 208 before the next step in the walking/running process. In a preferred embodiment, the channel 214 controls the fluid communication between the first chamber 206 and the second chamber 208 by not allowing flow of the fluid 210 from first chamber 206 to second chamber 208 unless the first chamber 206 is compressed and a pressure gets built up inside the first chamber 206 to overcome resistance offered by the second chamber 208 against its expansion.

Figure 5B:
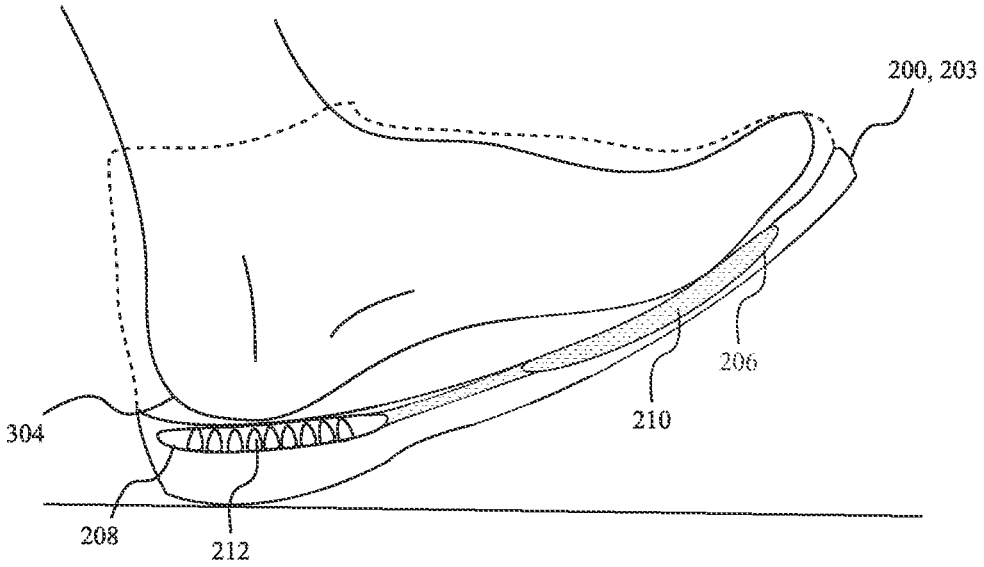
FIG. 5B illustrates side view of a runner's foot with the tactile feedback shoe sole with heel of the runner's foot resting on the heel portion of the tactile feedback shoe sole during strike of the heel during a rearfoot running in accordance with an embodiment of the present invention.

FIGS. 1A to 1E illustrate the conventional heel strike or rearfoot running technique in which the heel at position 100 (positions 102 and 104 as shown in close-up in FIG. 1B) strikes the ground first. In FIG. 5B the foot along with a footwear article using the tactile feedback shoe sole 200 or 203 is shown corresponding to foot positions 102 and 104. In heel strike running the heel strikes the ground first. So, unlike in forefoot running wherein the second chamber 208 is filled with the fluid before the heel 304 comes to rest on the heel portion 204, the second chamber 208 remains empty when the user follows rearfoot running technique i.e. both the first chamber 206 and the second chamber 208 remain in their normal size and shape. Thus, in rearfoot running, when the heel 304 rests on the second chamber 208 during the heel strike, the one or more projections 212 come directly against the heel 304 and press against the heel. The contact of the projections against the heel of the user may act as a feedback to the user of the tactile feedback shoe sole to indicate that the user is following a rear foot or heel strike running technique rather than forefoot running technique. In forefoot running, the second chamber gets filled with the fluid before the heel strike and, thus, the heel does not feel the projections due to the cushioning provided by the presence of the fluid in the second chamber.

It can be seen from the above description that the projections placed in the second chamber can make the user of the tactile feedback shoe sole aware of their presence by way of pressing against the heel of the user if the heel lands on the heel portion of the sole prior to the toe of the user landing on the toe portion of the sole. This happens because of the design of the tactile feedback shoe sole which makes the second chamber remain devoid of any fluid with the projections lying directly below the upper surface of the second chamber until the first chamber filled with the fluid is sufficiently compressed. In conventional rearfoot running the heel always strikes the ground before the toe makes contact with the ground in every step/stride. Thus, whenever a user walks or runs in heel strike or rearfoot technique using the tactile feedback shoe sole, the heel of the user is going to feel the projections upon impact. But, the user will not be able to feel the projections if the upper wall of the second chamber is not allowed to come in contact with the projection even under downward external pressure. This can be achieved by making the second chamber expand volumetrically thereby increasing the distance between the upper wall and the projections. The volumetric expansion in the second chamber can be created by pumping in the fluid from the first chamber when the first chamber is compressed before the heel lands on the heel portion i.e. when the first chamber is compressed but the second chamber is not compressed. Thus, the shoe sole of the present invention provides tactile feedback to a user of the shoe sole by way of the projections pressing against the heel when the heel of the user lands before the toe strikes the ground in a step as it happens in rearfoot running. No such feedback is given by the shoe sole of the present invention when the user runs or walks adopting the forefoot running or ball strike technique.

Figure 6:
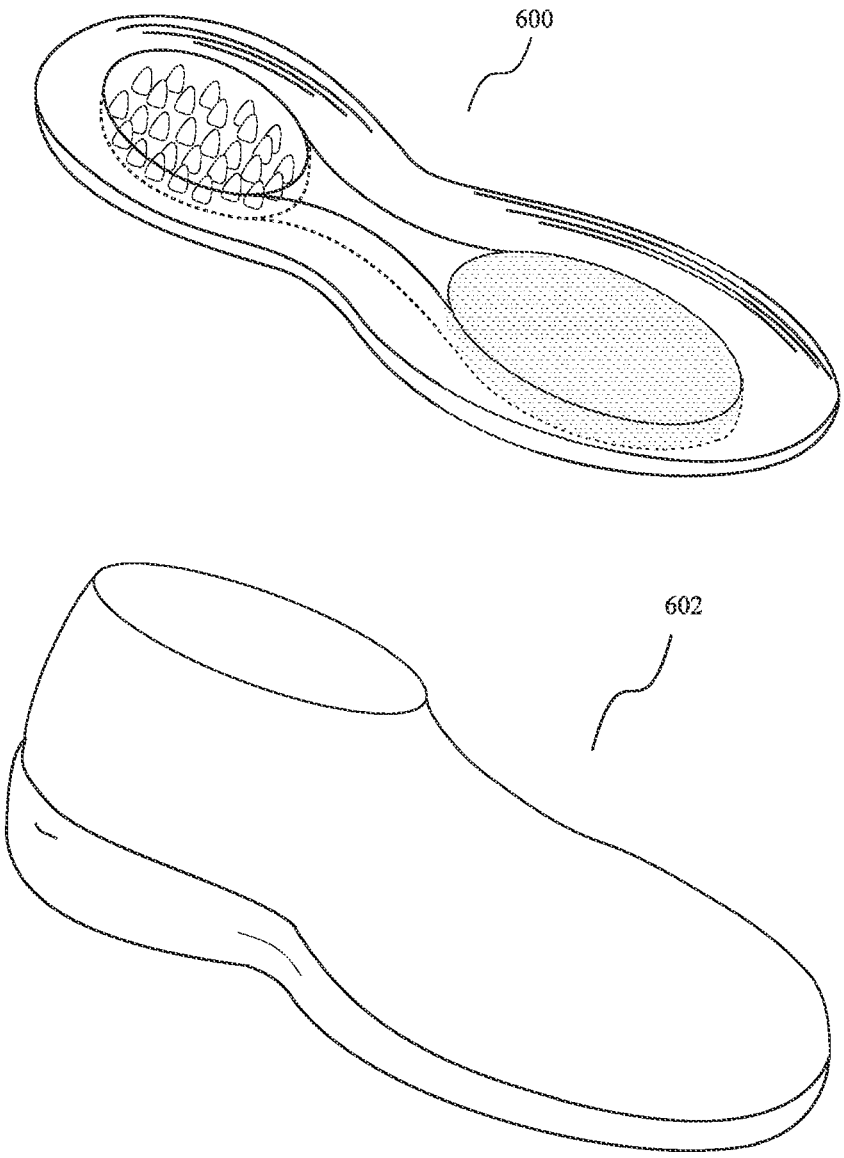
FIG. 6 illustrates perspective view of an insertable tactile feedback shoe sole in accordance with a third embodiment of the present invention.

FIG. 6 illustrates another embodiment of the tactile feedback shoe sole 600 which works in line with the principle of embodiments 200 or 203 but is an insole instead of being an integral part of a footwear article. The tactile feedback shoe sole 600 can be inserted into any conventional shoe such as 602 shown in FIG. 6.

Figure 7A:
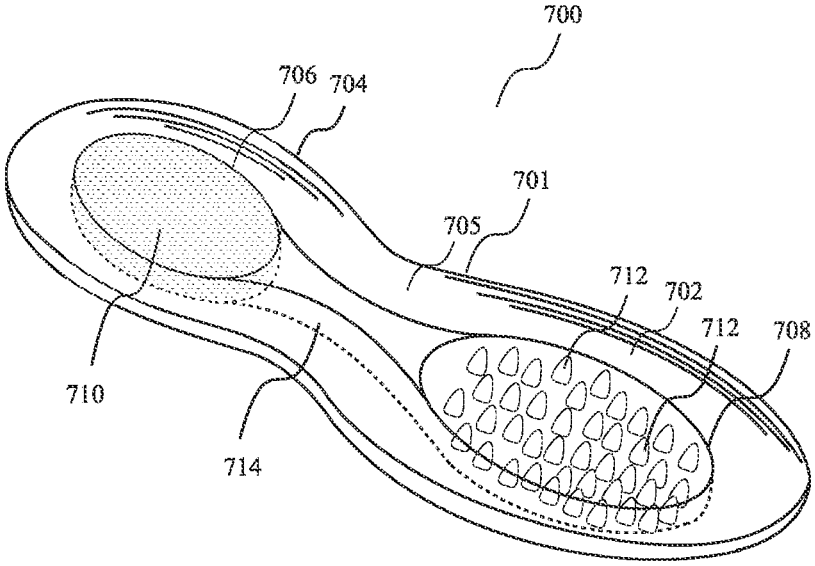
FIG. 7A illustrates perspective view of the tactile feedback shoe sole for rearfoot running in accordance with a fourth embodiment of the present invention.
Figure 7B:
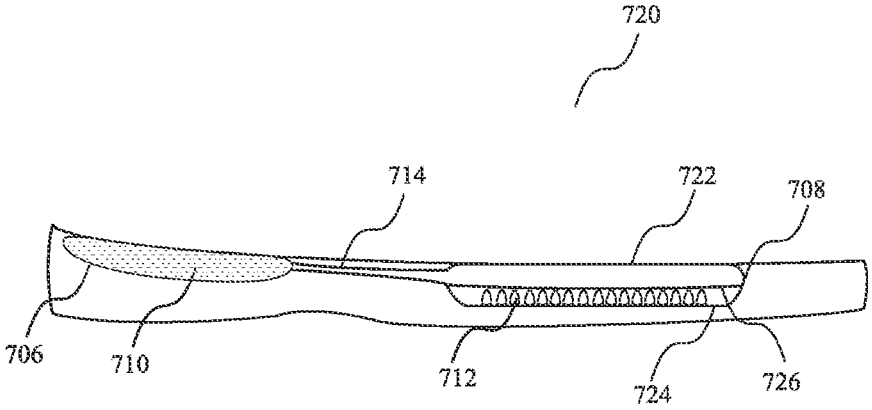
FIG. 7B illustrates a sectional view of the tactile feedback shoe sole for rearfoot running in accordance with a fourth embodiment of the present invention.

Although, the present invention has been described above in the context of encouraging forefoot running, in some embodiments, the tactile feedback shoe sole can be configured to provide feedback for encouraging rearfoot running, if required. In this embodiment, as shown in FIG. 7A, the first chamber 706 is disposed in the rear portion 704 and the second chamber 708 is disposed in the toe portion 702 of the tactile feedback shoe sole 700. In this embodiment also the first chamber 706 is filled with a fluid 710 and a channel 714 is disposed at the arch portion 705 of the main body 701 between the first chamber 706 and second chamber 708 which, when required, enables establishing of a fluidic communication between the two chambers. The embodiment 700 works on the same principle on which the embodiments 200, 203 or 600 work. In this embodiment, if the toe of the user strikes the ground first before the heel does, the user would feel the projections 712 under his/her toe as the toe chamber 708 would remain empty and unexpanded. But, if the heel strikes first then the first chamber 706 having the fluid 710 would cushion the impact of the heel the fluid would flow to the second chamber 708. So, subsequently, when the toe comes down it would land on the second chamber 708 filled with the fluid 710 and, as a result, the toe would not feel the projections. In another embodiment 720, which is almost similar to embodiment 700, as shown in FIG. 7B, the second chamber 708 further comprises an intermediate wall 726 that separates the second chamber upper wall 722 and the second chamber lower wall 724 and the one or more projections 712 disposed on the second chamber lower wall 724 terminate beneath the intermediate wall 726.

In some embodiments, the first chamber and the second chamber can have multiple sub-chambers. Each of the sub-chambers can be connected to each other or to one or more of the sub-chambers of the first chamber may remain directly in fluid communication with one or more sub-chambers of the second chamber through one or more channels.

Figure 8A:
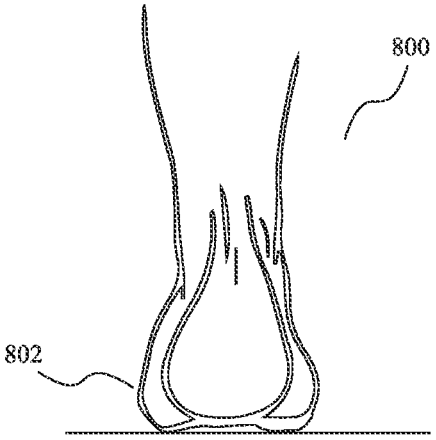
FIG. 8A illustrates a rear view of a foot on ground in normal condition.
Figure 8B:
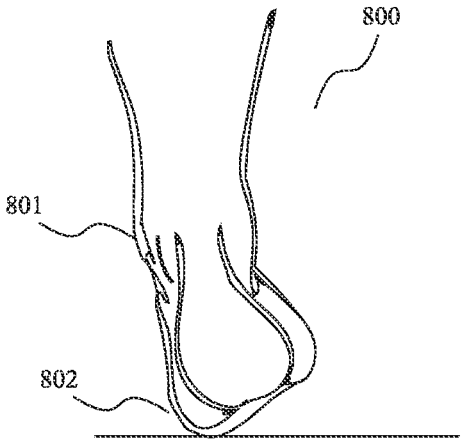
FIG. 8B illustrates a rear view of an overpronated foot on ground.

FIG. 8A illustrates a rear view of a right leg 800 with the foot 802 normally resting on ground. A right foot 800 that is excessively pronated or overpronated with the ankle 801 severely bent inward is shown in FIG. 8B.

Figure 9A:
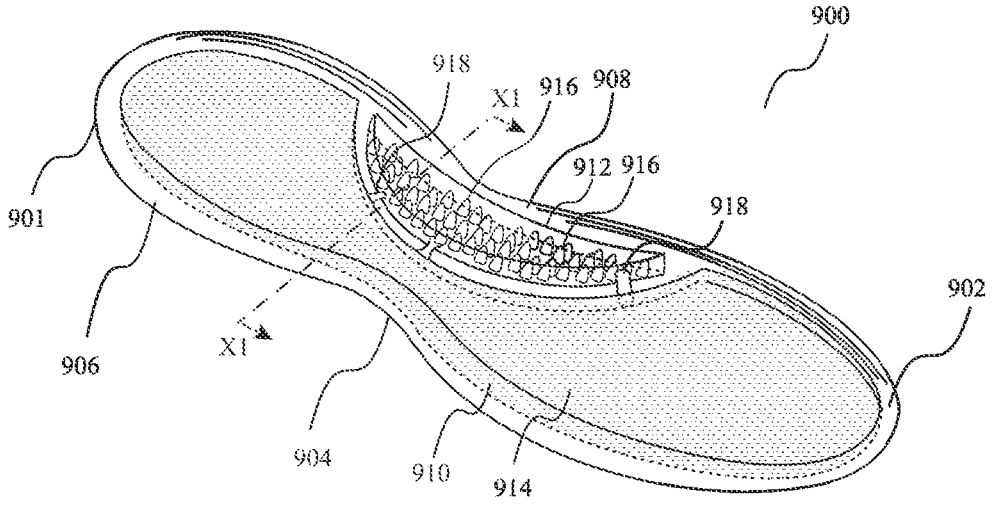
FIG. 9A illustrates a perspective view of a tactile feedback shoe sole in uncompressed state in accordance with a fifth embodiment of the present invention.
Figure 9B:
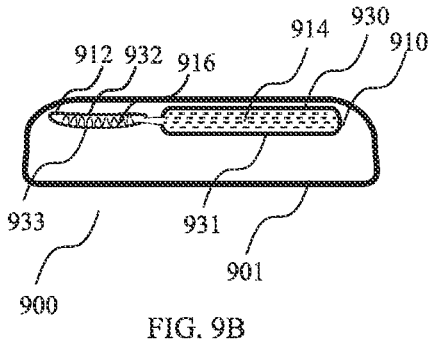
FIG. 9B illustrates a cross-sectional view of the tactile feedback shoe sole taken along line X1-X1 shown in FIG. 9A.

FIG. 9A illustrates a fifth embodiment of the tactile feedback shoe sole/insole 900 having a main body 901. The main body 901 comprises a front or toe portion 902, a rear or heel portion 906 and a middle portion 904. Reference to FIGS. 9A and 9B, the main body further comprises a first bladder or first chamber 910, a second bladder or second chamber 912 and one or more conduit or channels 918 through which a fluidic communication can be established between the first chamber 910 and the second chamber 912. The first chamber 910 comprises a first chamber upper wall 930 and a first chamber lower wall 931 spaced from said first chamber upper wall 930 and bonded together to cooperatively define a sealed space therebetween. Similarly, the second chamber 912 comprises a second chamber upper wall 932 and a second chamber lower wall 933 spaced from said second chamber upper wall 932 and bonded together to cooperatively define a sealed space therebetween. The upper walls 930, 932 and lower walls 931, 933 are made of flexible material which make the first chamber 910 and second chamber 912 squeezable and/or expandable under pressure and they retain their shape upon withdrawal of pressure from them.

The second chamber 912 includes one or more projections 916 extending from the second chamber lower wall 933 and terminating below the second chamber upper wall 932. In a preferred embodiment, each of the projections 916 may have a predetermined dimension (e.g. a spike like shape and thickness) and the projections 916 are disposed on the second chamber lower wall 933 at positions which may correspond to the locations of the sensitive points of the arch region of the foot. In another embodiment, similar to second chamber 208 shown in FIG. 2C or in FIG. 7B, the second chamber 912 further comprises an intermediate wall that separates the second chamber upper wall and the second chamber lower wall and cooperatively define a sealed space between the second chamber upper wall and the intermediate wall. The one or more projections disposed on the second chamber lower wall lie below the intermediate wall. In this embodiment the fluidic communication is established between the first chamber and the space between the second chamber upper wall and the second chamber intermediate wall.

Figure 10A:
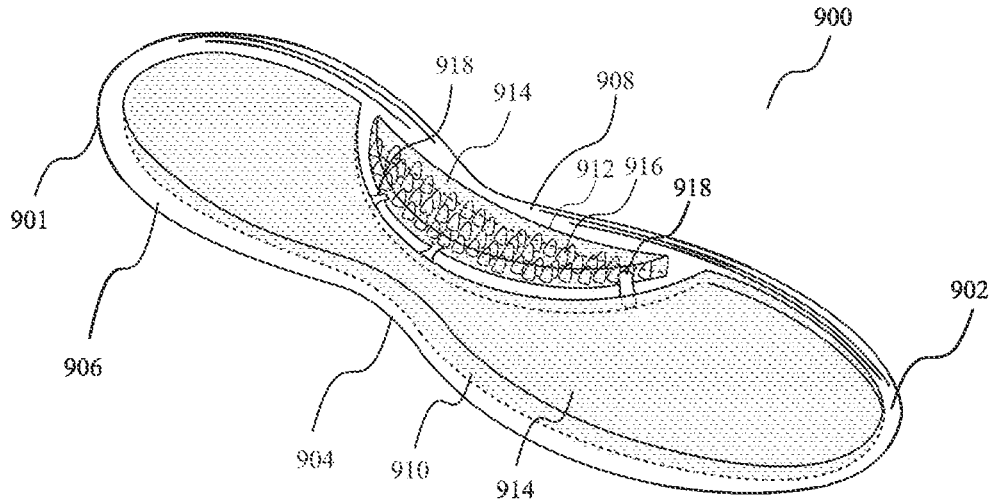
FIG. 10A illustrates a perspective view of a tactile feedback shoe sole in compressed state in accordance with the fifth embodiment of the present invention.

Although, FIGS. 9A and 10A illustrate the first chamber 910 being disposed all over the toe portion 902, rear portion 906 and middle portion 904, in some embodiments, the first chamber 910 is disposed on one or more specific areas of the toe portion 902, rear portion 906 or middle portion 904. For example, the first chamber 910 can be disposed either on the toe portion 902 or on rear portion 906 or on middle portion 904 or in any combination or in part of the toe portion 902, rear portion 906 and middle portion 904. Whatever be the coverage area of the first chamber 910 over the main body 901, the first chamber 910 is anatomically shaped to correspond to that part of the foot which generally touches ground. For example, if the first chamber 910 is placed only on the toe portion 902 then the first chamber 910 will be anatomically shaped to correspond to the toe portion of the foot which generally touches the ground. Similarly, although the second chamber 912 is shown disposed on the entire arch region 908 of the mid portion 904 of the main body 901, in some embodiments the second chamber 912 can be disposed to cover one or more specific areas of the arch region 908. The second chamber 912 is an arcuate chamber which is anatomically shaped to correspond to all of or part of the arch region of the foot. In some embodiments, in place of a single first chamber 910, there can be multiple first chambers which are separate or are inter-connected with each other. Similarly, the second chamber 912 can be multiple chambers instead of being a single chamber. The selective placement of the first chamber 910 and the second chamber 912, as discussed above, can be done in accordance with the need for different types or degree of pronation.

Figure 10B:
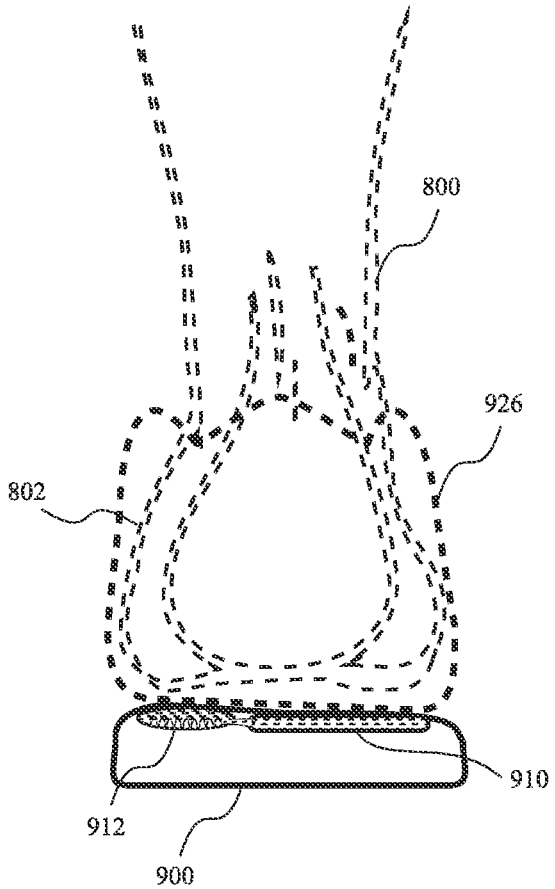
FIG. 10B illustrates a rear view of a foot resting on the tactile feedback shoe sole during normal standing/walking/running position in accordance with the fifth embodiment of the present invention.

The first chamber 910 is filled with a fluid 914 which can be a viscous liquid or a gel or any other suitable fluid. In a preferred embodiment, the channel 918 comprises a restrictive gate which allows controlled dynamic flow of the fluid between the chambers. As shown in the cross-sectional view in FIG. 9B, the first chamber 910 and the second chamber 912 are configured in such a way that, in partial or complete uncompressed condition i.e. when no/partial external pressure is applied on the first or second chambers, the first chamber 910 remains filled with the fluid and the second chamber 912 remains fully or partially devoid of the fluid 914. As long as the first chamber 910 remains uncompressed and fluid 914 doesn't fill the second chamber 912, the projections 916 come in direct contact with the second chamber upper wall 932 when an external pressure is applied on the second chamber upper wall 932. The volumes of the first chamber 910 and the second chamber 912 are configured in such a way that, when the first chamber 910 is partially/completely compressed and the fluid 914 flows into the second chamber 912 as shown in FIG. 10A. The fluid 914 makes the second chamber 912 expand resulting in not allowing the second chamber upper wall 932 to come in contact with the projections 916 even when the second chamber 912 is compressed i.e. external pressure is applied on the second chamber 912. FIG. 10B depicts such a condition wherein the tactile feedback shoe sole 900 is an integrated sole or a removable insole of a shoe 926 worn on right foot of the user. In this FIG. 10B, as can be seen in the cross-sectional view of the sole/insole 900, since the foot is resting normally on the ground, the first chamber 910 had got compressed first and the fluid 914 flowed to the second chamber 912 to fill and expand the second chamber 912 so that the projections 916 could not come in contact with the second chamber upper wall 932. Thus, when the user walk/runs normally without excessive pronation or overpronation, the user does not feel the projections 914. Rather, the expanded second chamber 912 provides a cushioning support to the arch region of the user during walking/running when the feet land normally/neutrally which can be beneficial to the users having flat feet problem. But, if the foot overpronates, then the second chamber 912 remains empty or partially filled with the fluid and the projections 916 are felt by the user's foot making the user aware of the overpronation.

In some embodiments, the normal i.e. the unexpanded volume of the second chamber 912 is configured to be smaller than the volume of the first chamber 910 in unexpanded condition. The chambers are preferably made of elastic material so that these chambers have the ability to resist a distorting influence and they return to their original size and shape when that influence or force/pressure exerted on them is removed. So, during the normal gait cycle with the feet landing normally/neutrally, every time the external force or pressure is withdrawn from the first chamber 910, the fluid 914 starts to flow back to the first chamber 910 from the second chamber 912 and, finally, prior to being compressed again, the first chamber 910 gets filled and the second chamber 912 becomes fully or partially empty.

Figure 11:
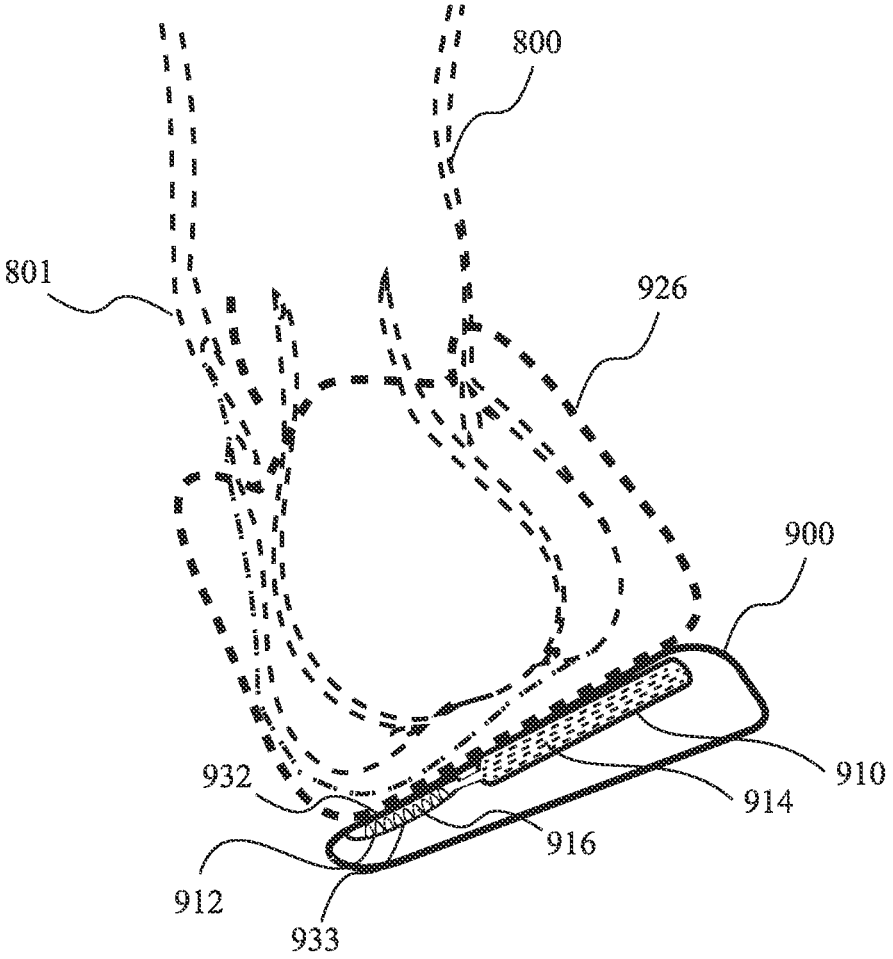
FIG. 11 illustrates a rear view of an overpronated foot resting on the tactile feedback shoe sole during standing/walking/running in accordance with the fifth embodiment of the present invention.

FIG. 11 depicts right foot 800 that is excessively pronated or overpronated with the ankle 801 severely bent inward. When it happens, the second chamber 912 gets pressed by the arch region of the foot before the foot fully compresses the first chamber 910. Since, the first chamber 910 either doesn't get compressed fully or gets compressed only partially, the fluid 914 also either does not flow or flows partially to the second chamber 912 from the first chamber 912. As a result, the projections 916 disposed in the second chamber 912 are felt by the arch region of the foot 800 of the user since they remain directly under the second chamber upper wall 932 in absence of sufficient fluid 914 inside the second chamber 912. This feeling of the projections under the arch region acts as a tactile feedback to the user whenever the foot pronates excessively or overpronates. The user is encouraged to put the feet correctly on ground while using the tactile feedback shoe sole/insole 900 as the arch region of the sole/insole 900 gives a cushioning effect when the feet do not overpronate. But, the same sole/insole 900 makes the user aware/causes discomfort when the feet overpronate.

What is claimed is:

1. A tactile feedback shoe sole for footwear comprising:

a main body that defines a toe portion, an arch portion and a heel portion;

a first chamber disposed in said toe portion or in said heel portion, said first chamber configured to remain filled with a fluid when said first chamber is in an uncompressed state;

a second chamber, said second chamber being disposed in said heel portion if said first chamber is disposed in said toe portion or said second chamber being disposed in said toe portion if said first chamber is disposed in said heel portion, said second chamber comprising a second chamber upper wall, a second chamber lower wall spaced from said second chamber upper wall, one or more projections disposed on said second chamber lower wall and an intermediate wall that separates said second chamber upper wall and said second chamber lower wall with said one or more projections terminating below said intermediate wall, said second chamber being configured to allow said second chamber upper wall to come in contact with said intermediate wall when said second chamber is in a compressed state under an external pressure and said first chamber is in said uncompressed state; and a channel disposed at said arch portion between said first chamber and said second chamber, said channel being configured to establish a fluidic communication between said first chamber and said second chamber when required;

wherein, said fluid flows from said first chamber to said second chamber through said channel and said fluid fills said second chamber to prevent said second chamber upper wall from coming in contact with said intermediate wall even under said external pressure when said first chamber was in a compressed state before said second chamber is in said compressed state and said fluid flows back to said first chamber when said first chamber is in said uncompressed state and said second chamber is in said compressed state.

2. The tactile feedback shoe sole as in claim 1, wherein said second chamber is smaller than said first chamber in volume in unexpanded state.

3. The tactile feedback shoe sole as in claim 1, wherein said channel comprises a restrictive gate that allows controlled dynamic flow of said fluid between said first chamber and said second chamber.

4. The tactile feedback shoe sole as in claim 1, wherein said first chamber and said second chamber are configured to return to their original size and shape when said external pressure is withdrawn.

5. A tactile feedback shoe sole for footwear comprising:

a main body that defines a toe portion, a middle portion and a heel portion;

a first chamber disposed on one or more areas of said toe portion, said middle portion or said heel portion, said first chamber configured to remain filled with a fluid when said first chamber is in an uncompressed state;

a second chamber disposed in one or more areas of an arch region in said middle portion, said second chamber comprising a second chamber upper wall, a second chamber lower wall spaced from said second chamber upper wall, one or more projections disposed on said second chamber lower wall and an intermediate wall that separates said second chamber upper wall and said second chamber lower wall with said one or more projections terminating below said intermediate wall, said second chamber being configured to allow said second chamber upper wall to come in contact with said intermediate wall when said second chamber is in a compressed state under an external pressure and said first chamber is in said uncompressed state; and one or more channels disposed between said first chamber and said second chamber, said one or more channels being configured to establish a fluidic communication between said first chamber and said second chamber when required;

wherein, said fluid flows from said first chamber to said second chamber through said one or more channels and said fluid fills said second chamber to prevent said second chamber upper wall from coming in contact with said one or more projections even under said external pressure when said first chamber was in a compressed state before said second chamber is in said compressed state and said fluid flows back to said first chamber when said first chamber is in said uncompressed state and said second chamber is in said compressed state.

6. The tactile feedback shoe sole as in claim 5, wherein said second chamber is smaller than said first chamber in volume in unexpanded state.

7. The tactile feedback shoe sole as in claim 5, wherein said one or more channels comprise a restrictive gate that allows controlled dynamic flow of said fluid between said first chamber and said second chamber.

8. The tactile feedback shoe sole as in claim 5, wherein said first chamber and said second chamber are configured to return to their original size and shape when said external pressure is withdrawn.

9. The tactile feedback shoe sole as in claim 5, wherein said first chamber is anatomically shaped to correspond to one or more parts of a foot which generally touch ground.

10. The tactile feedback shoe sole as in claim 5, wherein said second chamber is anatomically shaped to correspond to all of or part of said arch region.

* * * * *